US006075198A

United States Patent [19]

Grant et al.

[11] Patent Number: 6,075,198

[45] Date of Patent: Jun. 13, 2000

[54] SOLID BODY INSTRUMENT TRANSDUCER

[76] Inventors: W. Gerry Grant, 455 Rupp Rd.; James A. Reed, 385 Rupp Rd., both of Gettysburg, Pa. 17325

[21] Appl. No.: 09/133,306

[22] Filed: Aug. 13, 1998

Related U.S. Application Data

[63] Continuation-in-part of application No. 08/917,438, Aug. 19, 1997.

[51] Int. Cl.[7] ..... G10H 3/12; G10H 3/14; G10H 3/18

[52] U.S. Cl. ..... 84/731; 84/730; 84/723; 84/291; 84/DIG. 24

[58] Field of Search ..... 84/723–726, 730–731, 84/DIG. 24, 290–291

[56] References Cited

U.S. PATENT DOCUMENTS

| | | | |
|---|---|---|---|
| 3,453,920 | 7/1969 | Sherer | 84/1.16 |
| 3,733,425 | 5/1973 | Chaki | 84/1.14 |
| 4,030,396 | 6/1977 | Mariner | 84/1.16 |
| 4,189,969 | 2/1980 | Katayama et al. | 84/1.14 |
| 4,290,331 | 9/1981 | Izdebski | 84/1.14 |
| 4,378,721 | 4/1983 | Kaneko et al. | 84/1.14 |
| 4,567,805 | 2/1986 | Clevinger | 84/1.16 |
| 4,657,114 | 4/1987 | Shaw | 84/1.16 |
| 4,750,397 | 6/1988 | Ashworth-Jones | 84/1.16 |
| 4,860,625 | 8/1989 | Mathews | 84/1.16 |
| 4,867,027 | 9/1989 | Barbera | 84/731 |
| 5,123,325 | 6/1992 | Turner | 84/731 |
| 5,134,920 | 8/1992 | Clark | 84/730 |
| 5,140,887 | 8/1992 | Chapman | 84/646 |
| 5,204,487 | 4/1993 | Turner | 84/731 |
| 5,235,891 | 8/1993 | Klein | 84/291 |
| 5,322,969 | 6/1994 | Aaroe et al. | 84/731 |
| 5,455,381 | 10/1995 | Juskiewicz et al. | 84/731 |
| 5,463,185 | 10/1995 | Fishman | 84/731 |
| 5,499,541 | 3/1996 | Hopf et al. | 73/763 |
| 5,602,353 | 2/1997 | Juskiewicz et al. | 84/298 |
| 5,614,688 | 3/1997 | Donnell | 84/743 |
| 5,796,025 | 8/1998 | Haake | 84/464 |
| 5,817,966 | 10/1998 | Fishman | 84/731 |

*Primary Examiner*—David Martin
*Assistant Examiner*—Marlon T. Fletcher
*Attorney, Agent, or Firm*—Oldham & Oldham Co., LPA

[57] ABSTRACT

The present invention is a rigid, solid bodied stringed instrument having an electrical pickup embedded in at least one predetermined position within the stringed instruments solid body to pick up the actual wood tones and resonance of the rigid solid body. The electrical pickup is comprised of a piezoelectric transducer embedded between a planar brass surface and a planar ceramic surface. In the preferred embodiment, the pickup transducer is circular in shape and embedded within the stringed instrument's solid body adjacent the strings which span the body. The embedded piezoelectric transducer requires a fraction of the area required by traditional electric coil pickups. In an alternate preferred embodiment, the pickup transducer is embedded within a transducer housing. The housing is then embedded within the solid body of a stringed instrument adjacent the strings. By including the piezoelectric transducer within its own housing the pickup can be sold separately in the aftermarket and incorporated in solid body stringed instruments.

14 Claims, 5 Drawing Sheets

SOLID BODY INSTRUMENT TRANSDUCER

TECHNICAL FIELD

This is a continuation-in-part of application Ser. No. 08/917,438, filed Aug. 19, 1997. The present invention relates to solid body electric stringed instruments and more specifically to improved sound transducers for solid body electric guitars.

BACKGROUND OF THE INVENTION

Electric solid body guitars known in the prior art produce sound by using one or more electric coils to pick up the vibration of the strings (which must be of a magnetic material, normally steel) in a magnetic field. The electrical output of the coils is then amplified and the amplified signal is then reproduced by means of a loud speaker. Electric guitars produce relatively little direct sound energy themselves, and are totally reliant on amplification if they are to be heard by other than the player.

FIG. 1 shows electric solid body guitar 10 commonly found in the prior art consisting of solid body 12 having neck 20 extending therefrom and ending in head stock 16 which contains a plurality of tuning pegs 18 disposed within head stock 16. Mounted to body 12, opposite neck 20, is tailpiece 14 and bridge 28. Strings 22 are then coupled to body 12 by tailpiece 14 and stretched in parallel with one another over bridge 28, across body 12, over neck 20 and then ending with each string 22 being coupled to an independent tuning peg 18. Strings 22 are then tuned by tightening each string appropriately by winding the strings 22 around the tuning pegs. Bridge 28 allows strings 22 to be adjusted such that their height above neck 20 is at a position favorable to an individual playing guitar 10. Magnetic coil pickups 24 and 26 are mounted in solid body 12 and positioned beneath strings 22 such that the electric coils of pickups 24 and 26 sense the vibration of the strings in a magnetic field created by the pickups. The electrical output of the coils is coupled to output connector 8 disposed within solid body 12 allowing guitar 10 to be electrically connected to an external amplifier. The amplified signal is then reproduced by means of a loud speaker, not shown.

Solid, rigid body instruments are known to be less prone to feedback, possess better string sustain and provide a more even frequency response as compared to acoustic instruments although acoustic instruments are known to have superior tonal quality due to their sound producing bodies. FIG. 2 depicts acoustic guitar 40 as found in the prior art which is comprised of top 42 having side walls and a bottom, not shown, to create a sound box or cavity capable of reproducing and amplifying the vibrations of strings 22. Top 42 includes aperture 46 positioned beneath strings 22 which adds to the sound producing qualities of the sound box. As in FIG. 1, acoustic guitar 40 includes tailpiece 14 and bridge 28 having strings 22 coupled to top 42 by tailpiece 14. Extending from top 42, opposite tailpiece 14 and bridge 28, neck 20 extends ending in a head stock having tuning pegs as described for FIG. 1, although not shown. Strings 22 again are stretched over bridge 28 and between tailpiece 14 and the head stock. To provide amplification necessary for acoustic guitar 40 to be heard by large groups of people, such as when an acoustic guitar is played in a night club or stadium, transducer 44 is used. FIG. 2 demonstrates one method of amplification known in the prior art, that being to couple an electrical pickup to bridge 28 beneath strings 22. Transducer 44 may include a piezoelectric crystal which generates an electrical signal representative of the vibrations picked up through bridge 28 caused by strings 22.

FIG. 3 depicts an additional method known in the prior art for coupling an electrical transducer to an acoustic guitar for amplification purposes. Backside 36 of top 42 of an acoustic guitar is shown in FIG. 3 and includes aperture 46 and a plurality of support bars 50. Side view 38 of top 42 is also shown. Piezoelectric transducer 52 is coupled to the back 36 of top 42 adjacent aperture 46 in order to sense the vibration of the entire musical instrument and recreate a tone similar to the original sound produced by the strings.

There have also been numerous attempts to capture the advantages found in acoustic instruments for use with rigid solid body electric instruments which almost exclusively encompass variations on the bridge design of the guitar. Most prior art bridge designs consist of alternate arrangements of the instruments bridge with piezoelectric transducers, either individually or in groups. FIG. 4 shows such an arrangement which comprises top 60 of a guitar with bridge 72 mounted to the upper side of top 60. Bridge 72 includes a slot in which saddle 70 is maintained which will eventually have strings 68 stretched over it. Disposed between bridge 72 and saddle 70 is transducer 62 which is comprised of a piezoelectric transducer having output lead 64 disposed through hole 66 within bridge 72 and top 60 which couples transducer 62 to external amplification equipment. Transducer 62 senses and generates an electrical signal representative of the vibrations from string 68 transmitted through saddle 70, bridge 72 and top 60. By incorporating piezoelectric transducers or other small transducers within the bridge or under the string saddles of the bridge the configurations of the prior art simulate the resonance and tonal qualities present in acoustic instruments only after the string vibrations have transferred from a string through a metal saddle bridge to the electrical transducer. Due to attenuation and distortion induced into the strings vibration by the bridge and its various components, actual wood tones and resonance are not captured by the electrical transducer thereby compromising the tonal qualities of the solid body stringed instrument.

Therefore, in light of the foregoing deficiencies in the prior art, Applicant's invention is herein presented.

SUMMARY OF THE INVENTION

In summary, the present invention is a rigid, solid bodied stringed instrument having an electrical pickup embedded in at least one predetermined position within the stringed instruments solid body to pick up the actual wood tones and resonance of the rigid solid body. The electrical pickup is comprised of a piezoelectric transducer embedded between a planar brass surface and a planar ceramic surface. In the preferred embodiment, the pickup transducer is circular in shape and embedded within the stringed instrument's solid body adjacent the strings which span the body. The embedded piezoelectric transducer requires a fraction of the area required by traditional electric coil pickups. In an alternate preferred embodiment, the pickup transducer is embedded within a transducer housing. The housing is then embedded within the stringed instrument's solid body adjacent the strings. By including the piezoelectric transducer within its own housing the pickup can be sold separately in the aftermarket and incorporated in solid body stringed instruments.

It is, therefore, an object of the present invention to provide a rigid solid bodied stringed instrument providing improved tonal qualities not found in prior art solid bodied stringed instruments and including tonal qualities previously available only in acoustic bodied instruments.

It is also an object of the invention to provide an economical and improved means of producing a rigid solid bodied stringed instrument providing improved tonal qualities.

Another object of the invention is to provide an electrical transducer which occupies less area within a stringed instrument's solid body thereby making the instrument as a whole more aesthetically pleasing while maintaining the structural integrity of the solid body due to the decreased area necessary for coupling the transducer to the solid body.

A further object of the invention is to provide a retrofittable piezoelectric pickup for a stringed instrument by embedding a piezoelectric transducer within a housing which is in turn embedded within the stringed instrument's solid body.

These along with other objects and advantages of the present invention will become more readily apparent from a reading of the detailed description taken in conjunction with the drawings and the claims.

DETAILED DESCRIPTION OF THE PREFERRED EMBODIMENT

Figure 5:
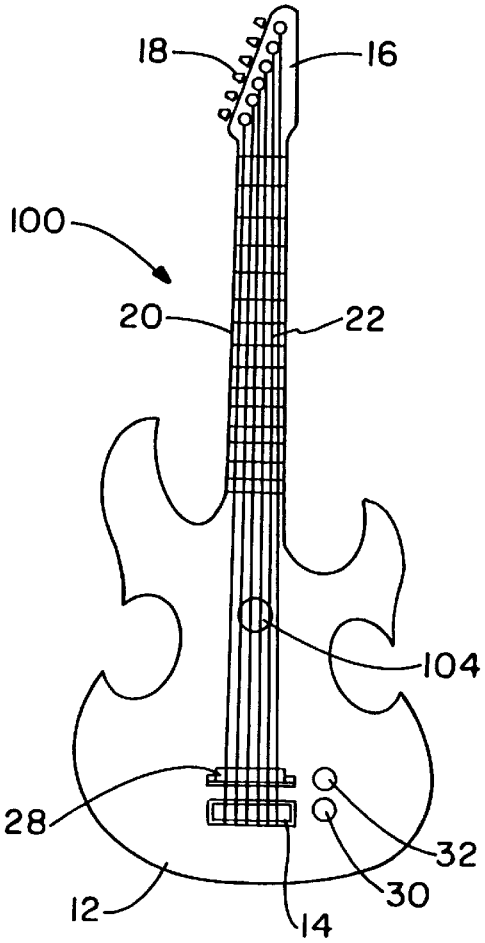
FIG. 5 is a front elevational view of a solid body electric guitar in accordance with the preferred embodiment of the present invention.

FIG. 5 shows solid body electric guitar 100 which is the preferred embodiment of the present invention. Just as in the prior art, solid body electric guitar 100 is comprised of solid body 12 having neck 20 extending outward from one end of body 12 and ending with head stock 16 having a plurality of tuning pegs 18. Solid body 12 can be fabricated from a number of materials with wood being the most likely and common. While any number of wood types and combinations of different woods may be used, in the preferred embodiment solid body 12 is fabricated from one or more of the following: solid walnut, curly maple, and cherry. Coupled to solid body 12 opposite of neck 20 are tailpiece 14 and bridge 28 both coupled adjacent one another and in parallel. Tailpiece 14 and bridge 28 comprise the string retention means of guitar 10. Strings 22 are coupled to solid body 12 by tailpiece 14 and then stretched over bridge 28, neck 20, and then coupled to head stock 16 by tuning pegs 18. The improvement over the prior art is the use of piezoelectric transducer 104 which is embedded within solid body 12 and positioned in a predetermined manner below strings 22. As will be described in more detail later in relation to FIG. 8, piezoelectric transducer 104 is placed within a bore made in solid body 12 and then covered so that transducer 104 is completely embedded within solid body 12.

Figure 1:
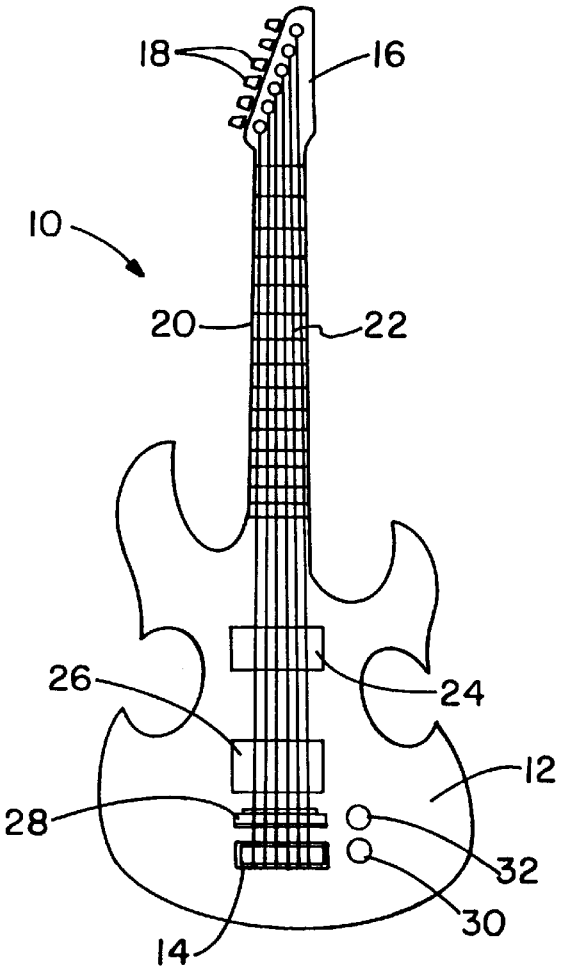
Prior Art FIG.-1
FIG. 1 is a front elevational view of a typical electric solid body guitar found in the prior art.
Figure 2:
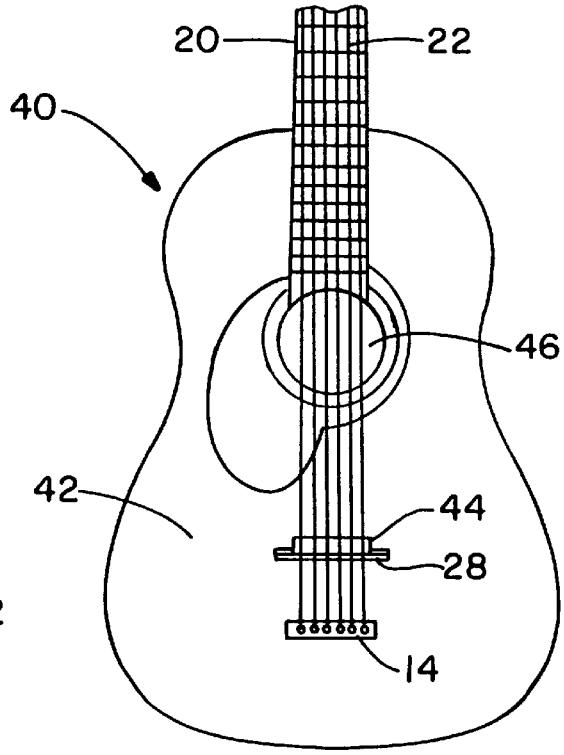
Prior Art FIG.-2
FIG. 2 is a front elevational view of a typical acoustic guitar found in the prior art.
Figure 3A:
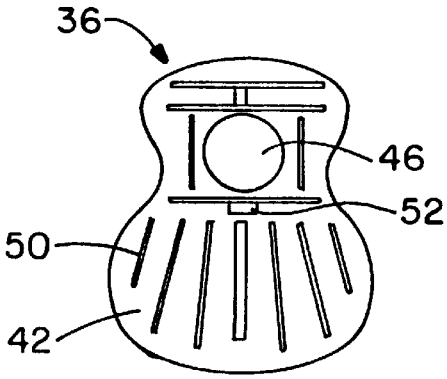
Prior Art FIG.-3A
FIG. 3 is a front and side elevational view of an acoustic guitar top having an electric sound transducer as found in the prior art.
Figure 3B:
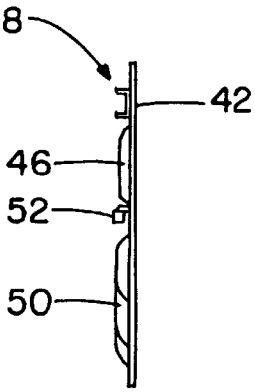
Prior Art FIG.-3B
Figure 4:
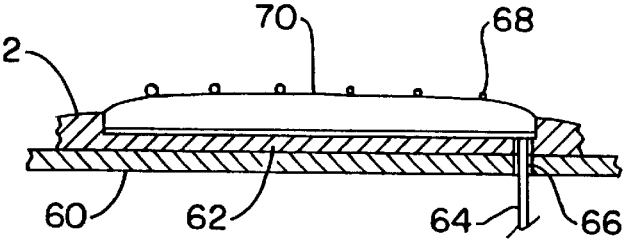
FIG.-4 Prior Art
FIG. 4 is a guitar bridge in combination with an electrical sound transducer as found in the prior art.

As compared to the prior art in which a piezoelectric transducer is either coupled to the bridge or to the top of the guitar or other stringed instrument, by embedding piezoelectric transducer 104 within solid body 12 actual wood tones and resonance are sensed and translated to amplification equipment thereby providing a fuller and more pleasing tone while eliminating unwanted feedback which can be caused in the prior art by portions of the transducer being exposed to the surrounding atmosphere. Transducer 104 is coupled to internal circuitry of guitar 100 and then to an external amplifier via output connector 8 in the same manner as more traditional electric magnetic coil pickups. Output connector 8 is disposed within solid body 12 as described for the prior art shown in FIG. 1. FIG. 5 shows that some of the circuitry is comprised of volume control 30 and toggle switch 32 which allow the user to control the tone and volume of the stringed instrument.

Figure 6:
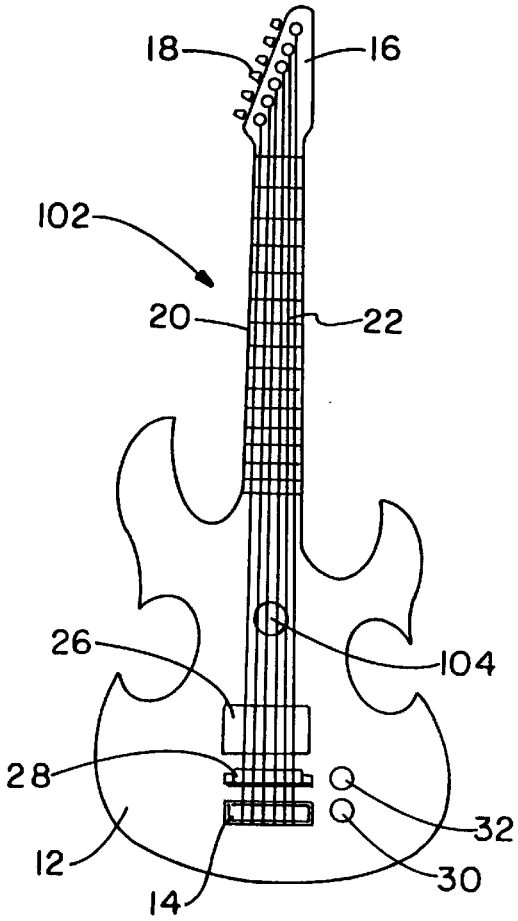
FIG. 6 is an alternate embodiment of a solid body electric guitar in accordance with the present invention.

Solid body electric guitar 102 shown in FIG. 6 is an alternative embodiment in which magnetic coil pickup 26 is also employed along with piezoelectric transducer 104 to provide additional sound effects controlled through toggle switch 32 and any external amplification. In this configuration, the user of guitar 102 has the option of using transducer 104 to obtain improved sound and tone qualities or he or she may opt for the more traditional electric magnetic coil pickup sound or both pickup 26 and transducer 104 may be used in tandem to obtain hybrid sounds.

Figure 7:
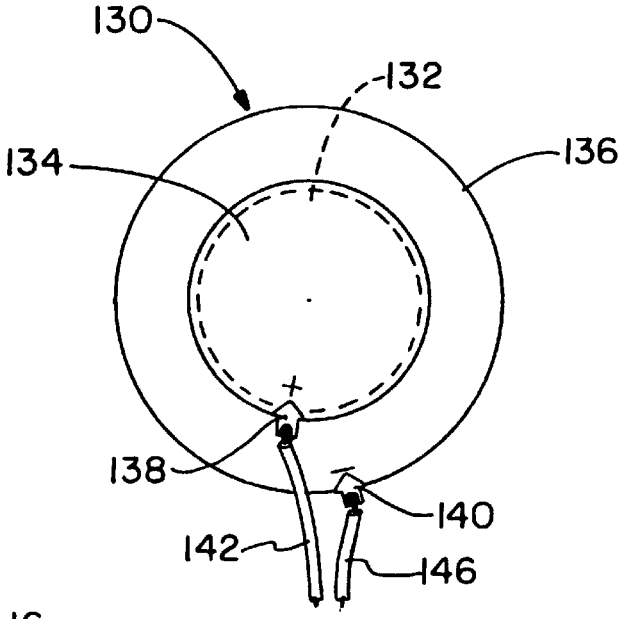
FIG. 7 is a top plan view of a piezoelectric transducer having a partially ghosted view.

Although numerous types of piezoelectric transducers are suitable for use in the present invention, in the preferred embodiment piezoelectric transducer 130 shown in FIG. 7 is used. Transducer 130 is comprised of planar brass wafer 136 having negative terminal 140 physically and electrically coupled to brass wafer 136 which allows wire 146 to electrically couple to brass wafer 136. Brass wafer 136 provides the negative polarity coupling or ground for piezoelectric transducer 130. Coupled to brass wafer 136 is planar ceramic disk 134 having a conductive underside wherein the conductive underside (not shown) is coupled to terminal 138 having wire 142 extending from terminal 138 to provide the positive electrical connection for transducer 130. Shown in ghosted lines is piezo element 132 which is sandwiched and maintained between brass wafer 136 and ceramic disk 134 thereby insulating the conductive underside of ceramic disk 134 from brass wafer 136. Piezo element 132 generates electrical signals in response to vibrations and movement and these electrical signals correspond to the vibrations of the strings on the instrument. The electrical signals conduct through brass wafer 136 and the conductive underside of ceramic disk 134, through terminals 138 and 140, wires 142 and 146 and eventually to external amplification equipment.

Another type of piezoelectric transducer contemplated by Applicant is a polarized homopolymer of vinylidene fluoride (PVDF) sold under the trademark "KYNAR". This type of transducer is comprised of a plastic film which is available in a number of thicknesses. PVDF has a high output voltage for a given mechanical stress. It also has a low mass and a low Q, which means that it responds instantly to a mechanical input, and introduces little coloration of the sound. These characteristics make PVDF ideal for use with solid body electric instruments. Piezoelectric transducers fabricated from PVDF are more fully described in U.S. Pat. No. 5,204,487 to Turner, which is incorporated herein by reference.

Figure 8:
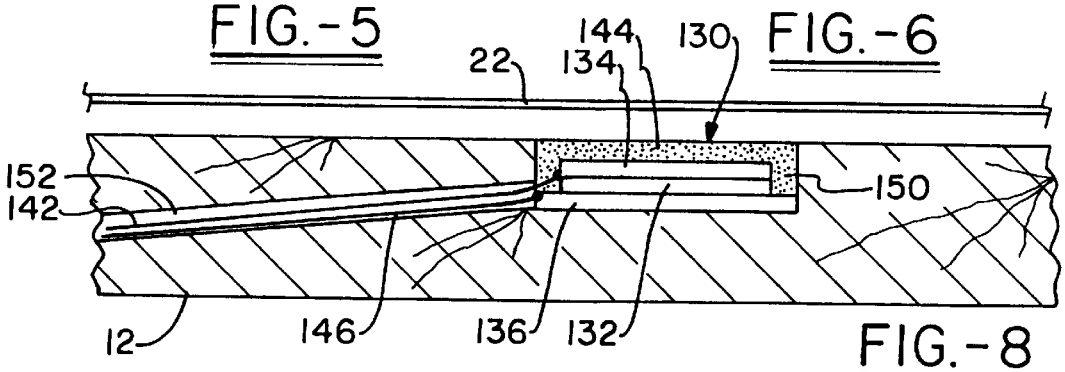
FIG. 8 is a side elevational view in cross section of the solid body of a stringed instrument with a piezoelectric transducer coupled therewith in accordance with the preferred embodiment of the present invention.

FIG. 8 shows piezoelectric transducer 130 embedded within solid body 12 and positioned beneath strings 22. In order to embed piezoelectric transducer 130 within solid body 12, cavity 144 is created by removing a small area of wood or material from solid body 12. In the preferred embodiment, cavity 144 is comprised of a circular bore having a depth of approximately 3/32" and a diameter of 1¼". These measurements will vary depending on the size of piezoelectric transducer 130 and in the preferred embodiment transducer 130 is within the recited dimensions. Transducer 130 including brass wafer 136, piezo element 132 and ceramic disk 134 are shown disposed within cavity 144 with wires 142 and 146 disposed through bore 152 which routes the wires to additional circuitry within the guitar which will eventually be coupled to external amplification equipment. Once transducer 130 is placed within cavity 144, body fill 150 is placed over transducer 130 and within cavity 144 to fully embed transducer 130 within solid body 12. Body fill 150 can consist of numerous materials including wooden cut plugs, polymers, plastics or fiberglass materials or any other material which can maintain transducer 130 within cavity 144 and assist in transmitting vibrations from strings 22 to transducer 130. In the preferred embodiment body fill 150 is comprised of a thin layer of putty similar to that used for auto body repair. The putty maintains transducer 130 within cavity 144 and has the requisite characteristics to assist in the transfer of vibrations from strings 22.

Figure 9:
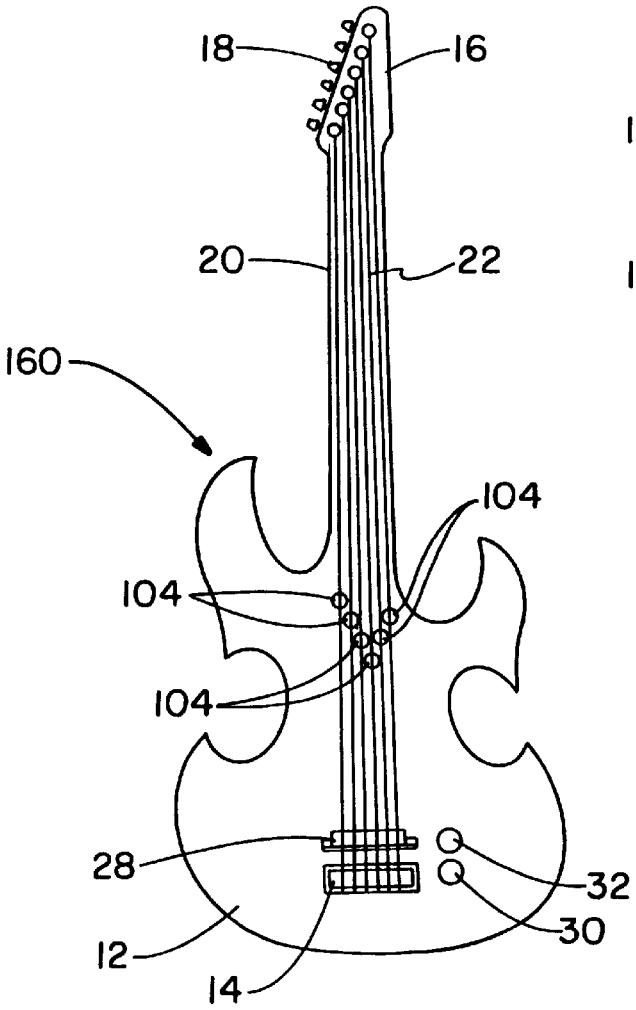
FIG. 9 is a front elevational view of a further alternate embodiment of a solid body electric guitar having a plurality of pickup transducers.

Solid body electric guitar 160 as shown in FIG. 9 is a further alternate embodiment of the present invention. In the place of a single piezoelectric transducer, a plurality of piezoelectric transducers 104 are used and positioned such that each transducer 104 corresponds to each individual string 22 of guitar 160. By employing an individual transducer 104 for each string the sound characteristics of guitar 160 can be controlled and modified by external amplification and mixing equipment to provide a more dynamic range of sounds while obtaining the benefits of the embedded piezoelectric transducer configuration of the present invention.

Figure 10:
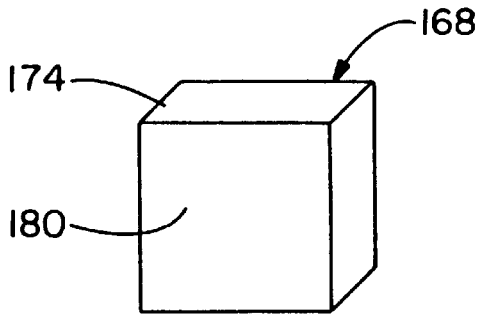
FIG. 10 is a perspective view of one side of a piezoelectric pickup in accordance with one preferred embodiment of the present invention.
Figure 11:
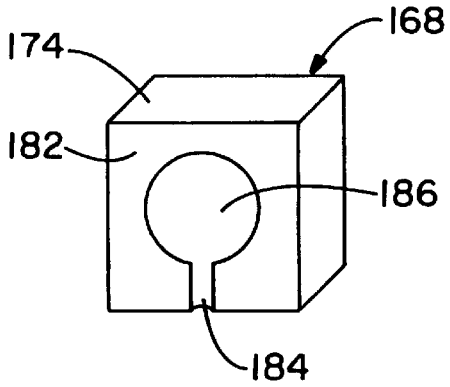
FIG. 11 is a perspective view of a second side of the piezoelectric pickup shown in FIG. 10.

FIGS. 10–17 are directed towards an alternate embodiment of the present invention which consists of a retrofittable, aftermarket piezoelectric pickup which is then incorporated within a stringed instrument solid body. The retro-fit piezoelectric pickup senses and translates actual wood tones and resonance to amplification equipment thereby providing a fuller and more pleasing tone eliminating unwanted feedback just as in the previous embodiments of the present invention. FIGS. 10 and 11 show transducer housing 174 of piezoelectric pickup 168. The outer surface 180 of transducer housing 174 will remain flush with the top of the stringed instrument when piezoelectric pickup 168 is embedded within the instrument. The inner surface 182 of piezoelectric pickup 168 includes transducer cavity 186 formed in approximately the center of transducer housing 174, with wire channel 184 extending from an edge of transducer cavity 186 to an outer edge of transducer housing 174.

Figure 12:
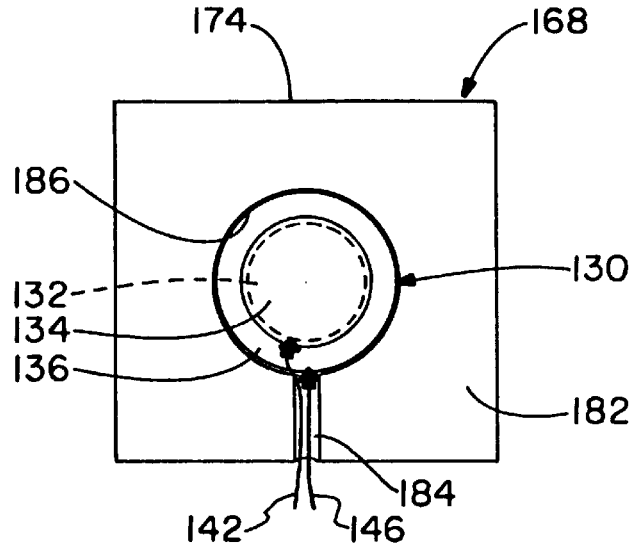
FIG. 12 is a back elevational view of the coupling of a piezoelectric transducer within the transducer housing of the piezoelectric pickup of the present invention.
Figure 13:
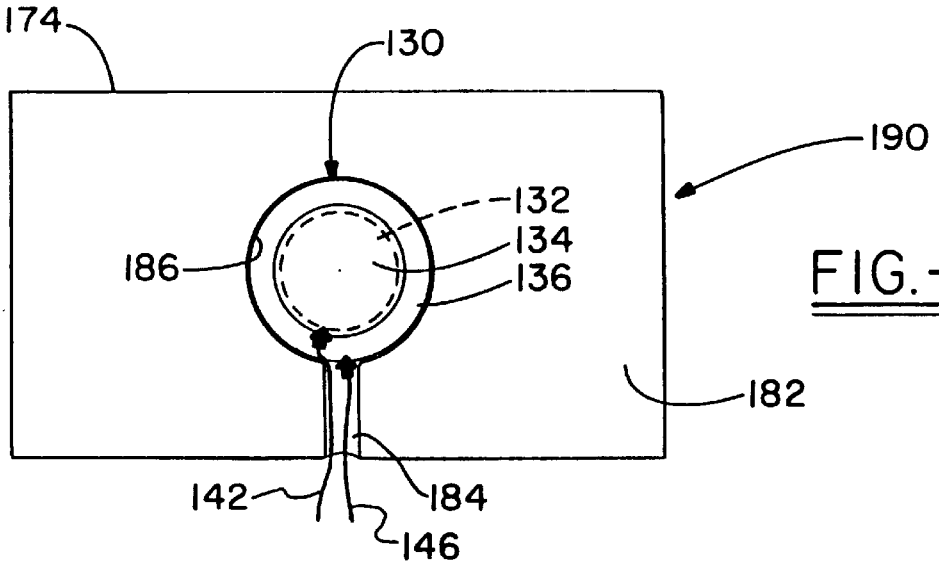
FIG. 13 is a back elevational view of the coupling of a piezoelectric transducer within the transducer housing of an extended piezoelectric pickup embodiment of the present invention.
Figure 14:
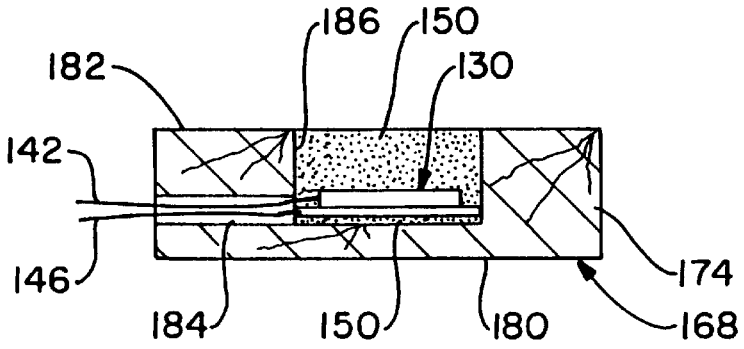
FIG. 14 is a side elevational view in cross section of the piezoelectric pickup of the present invention.

Turning to FIGS. 12–14, the coupling of piezoelectric transducer 130 within transducer housing 174 will be described in further detail. In the same manner as described for the previous embodiments, piezoelectric transducer 130, again comprised of brass wafer 136, piezo element 132 and ceramic disk 134, is embedded within transducer cavity 186 with wires 142 and 146 disposed in wire channel 184. The wires run from within transducer cavity 186 out of transducer housing 174 where they will eventually be coupled to additional circuitry within the stringed instrument and then to external amplification equipment. Just as in the earlier embodiments, once transducer 130 is placed within cavity 186 body fill 150 is used to fully embed transducer 130 within transducer housing 174. In the preferred embodiment, body fill 150 is comprised of a putty similar to that used for auto body repair. A thin layer of putty may be placed within transducer cavity 186 with piezoelectric transducer 130 then placed on top of the putty. Body fill 150 is then placed over the top of piezoelectric transducer 130 to completely fill and seal transducer cavity 186 and wire channel 184. The end result can be seen in FIG. 15 in which piezoelectric pickup 168 is shown as a solid block with the positive 142 and negative 146 wires extending from one side of transducer housing 174.

Piezoelectric pickup 168 will typically have a smooth and finished surface as a result of sanding and preparing the body fill 150 and surfaces of transducer housing 174. While transducer housing 174 can be fabricated from a number of materials, in the preferred embodiment housing 174 is comprised of wood such as solid walnut, curly maple or cherry. In addition, any number of other materials capable of translating string vibrations through the instruments solid body to piezoelectric transducer 130 may also be used. FIG. 14 also shows an alternate arrangement in which wire channel 184 is a bore extending from one outside edge of transducer housing 174 to within transducer cavity 186. In this embodiment, body fill 150 is only used within cavity 186 as it is no longer necessary to seal wires 142 and 146 which are completely embedded within the walls of transducer housing 174.

Figure 15:
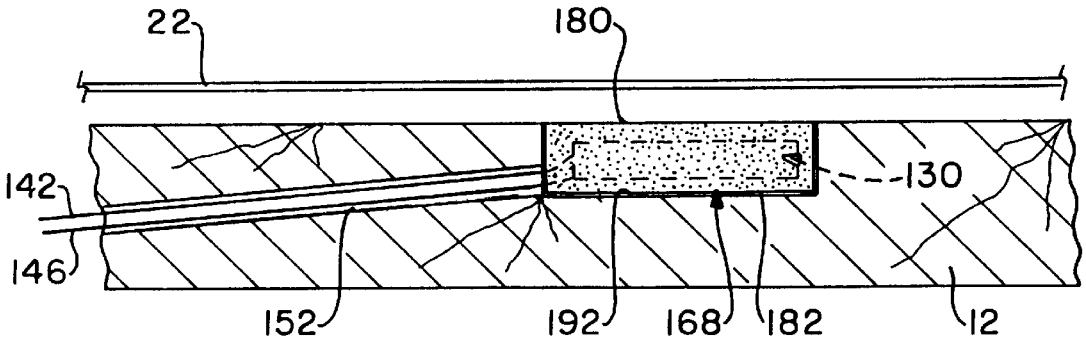
FIG. 15 is a side elevational view in cross section of the piezoelectric pickup of the present invention embedded within a solid body.

FIG. 15 shows piezoelectric pickup 168 embedded within solid body 12 and positioned beneath strings 22. To prepare solid body 12 of a stringed instrument for installation of piezoelectric pickup 168, cavity 192 is created by removing or routing an area equal to the size of transducer housing 174. In addition, bore 152 must also be added running from cavity 192 to another position within solid body 12 where wires 142 and 146 are then coupled to additional circuitry. Once cavity 192 is completed, piezoelectric pickup 168 is placed within cavity 192 so that inner surface 182 is within cavity 192 and outer surface 180 is facing strings 22. If cavity 192 is formed with enough precision piezoelectric pickup 168 will be maintained within solid body 12 through resistive fit coupling. In addition, numerous types of adhesives can be placed within cavity 192 to ensure pickup 168 cannot be removed from solid body 12. In the preferred embodiment, a two part polymer epoxy is used.

Figure 16:
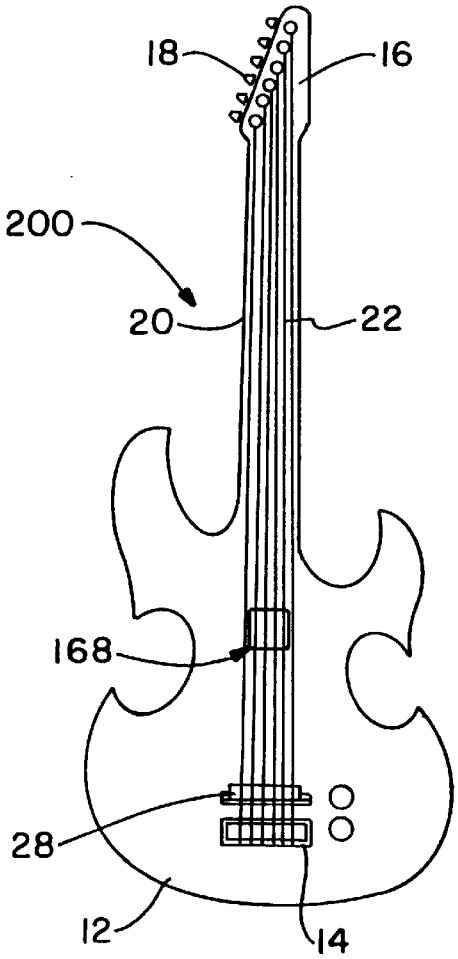
FIG. 16 is a front elevational view of a solid body electric guitar with an extended piezoelectric pickup of the present invention coupled within the solid body.
Figure 17:
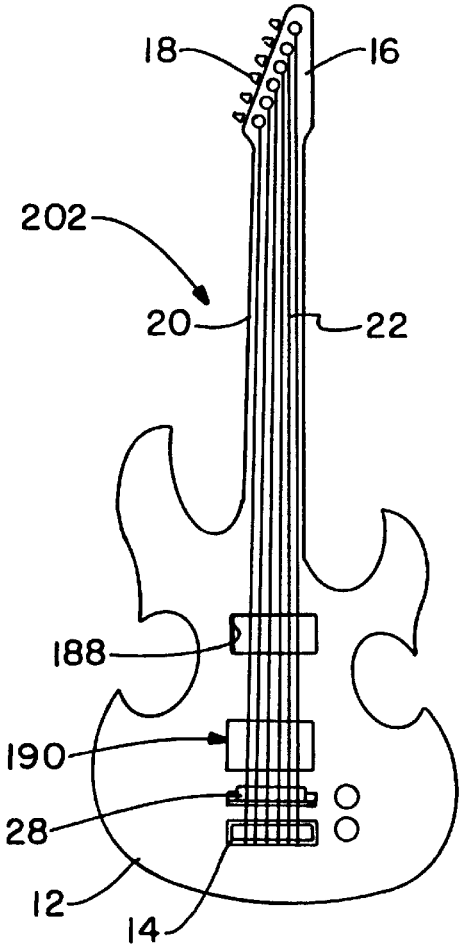

FIG. 16 shows electric guitar 200 having piezoelectric pickup 168 coupled within solid body 12 and positioned beneath strings 22. FIG. 17 shows a typical electric guitar which has not been modified to receive the piezoelectric pickup 168 of the present invention. Instead, guitar 202 is a standard instrument which includes electromagnetic pickups found in the prior art. Typically these pickups are rectangular in shape and when removed from guitar 202 leave an enlarged standard pickup cavity 188 within solid body 12. To accommodate the vast number of standard instruments currently available an alternate embodiment of pickup 168 is found in extended piezoelectric pickup 190 as shown in FIGS. 13 and 17. Extended pickup 190 is exactly the same as pickup 168 except that transducer housing 174 is elongated and formed in a rectangular shape that matches the size of standard electromagnetic pickups thereby allowing piezoelectric pickup 190 to replace the standard pickups without farther alteration of an instruments solid body Although preferred embodiments of the invention have been described herein, various changes or modifications are contemplated within the invention and would be apparent to those skilled in the art. The invention is therefore not to be limited to the preferred embodiment, but only according to the appended claims.

What is claimed is:

1. A pickup for a solid body stringed instrument comprising:

a piezoelectric transducer;

a wooden transducer housing having a cavity formed therein for receiving said piezoelectric transducer; and body fill covering said piezoelectric transducer and said cavity embedding said piezoelectric transducer within said wooden transducer housing;

wherein said piezoelectric transducer senses tones and resonance translated through said wooden transducer housing when said pickup is mounted directly within said solid body of said stringed instrument thereby maintaining said piezoelectric transducer beneath the surface of said solid body.

2. A pickup as recited in claim 1, wherein said piezoelectric transducer comprises:

a planar metal surface, said planar metal surface having a first side and a second side;

a piezoelectric element coupled to said first side of said planar metal surface; and a planar ceramic surface, said planar ceramic surface having a first side and a second side, wherein said first side of said planar ceramic surface includes a conductive coating, and wherein said planar ceramic surface is coupled to said piezoelectric element so that said conductive coating and said piezoelectric element are electrically connected to one another.

3. A pickup as recited in claim 1, wherein said wooden transducer housing is fabricated from a wood selected from the group consisting of walnut, curly maple and cherry.

4. A pickup as recited in claim 1, wherein said body fill is a material selected from the group consisting of wood, putty, plastic, polymers and fiberglass.

5. A pickup as recited in claim 1, wherein said wooden transducer housing is formed into a size equivalent to a standard electro-magnetic pickup to allow said pickup to replace said standard electro-magnetic pickup without alteration to said stringed instrument.

6. A stringed instrument comprising:

at least one piezoelectric transducer;

a wooden solid body having at least one cavity formed therein for receiving said at least one piezoelectric transducer;

an elongated neck extending from said solid body, wherein said elongated neck ends in a head stock having a plurality of tuning pegs;

a string retention means coupled to the top of said solid body;

a plurality of strings stretched across the top of said solid body and said elongated neck with said plurality of strings coupled between said string retention means and said plurality of tuning pegs;

an output connector coupled to said solid body, wherein said piezoelectric transducer is electrically connected to said output connector; and body fill covering said piezoelectric transducer and said cavity embedding said piezoelectric transducer within said solid body;

wherein said piezoelectric transducer is mounted beneath the surface of said solid body to sense tones and resonance translated from said stringed instrument through said solid body.

7. A stringed instrument as recited in claim 6, wherein said wooden solid body is fabricated from a wood selected from the group consisting of walnut, curly maple and cherry.

8. A stringed instrument as recited in claim 6, wherein said body fill is a material selected from the group consisting of wood, putty, plastic, polymers and fiberglass.

9. A stringed instrument as recited in claim 6, wherein said at least one piezoelectric transducer comprises:

a planar metal surface, said planar metal surface having a first side and a second side;

a piezoelectric element coupled to said first side of said planar metal surface; and a planar ceramic surface, said planar ceramic surface having a first side and a second side, wherein said first side of said planar ceramic surface includes a conductive coating, and wherein said planar ceramic surface is coupled to said piezoelectric element so that said conductive coating and said piezoelectric element are electrically connected to one another.

10. A stringed instrument as recited in claim 6, further comprising:

a plurality of piezoelectric transducers;

wherein said wooden solid body includes a plurality of cavities formed therein for receiving said plurality of piezoelectric transducers;

wherein said plurality of piezoelectric transducers are electrically connected to said output connector; and wherein said plurality of piezoelectric transducers are located in predetermined positions within said wooden solid body such that each piezoelectric transducer senses predominantly the vibrations of only one of said plurality of strings.

11. A stringed instrument as recited in claim 6, wherein said stringed instrument is an electric guitar.

12. A stringed instrument as recited in claim 6, wherein said stringed instrument is an electric bass guitar.

13. A method of embedding a piezoelectric transducer within a solid bodied instrument as recited in claim 6, comprising the steps of:

boring at least one cavity within said wooden solid body for receiving said piezoelectric transducer;

boring an aperture within said cavity to said output connector for electrically connecting said piezoelectric transducer to said output connector;

operatively positioning said piezoelectric transducer within said cavity; and filling in said cavity with body filler to embed said piezoelectric transducer within said wooden solid body to sense tones and resonance translated from said stringed instrument through said wooden solid body.

14. A method as recited in claim 13, wherein said body filler is a material selected from the group consisting of wood, putty, plastic, polymers and fiberglass.

* * * * *